US006199552B1

(12) United States Patent
Crespo

(10) Patent No.: US 6,199,552 B1
(45) Date of Patent: Mar. 13, 2001

(54) BED WITH SUSPENDED PLATFORM

(76) Inventor: Pedro R. Crespo, 10126 NW. 80 Ave., Hialeah Gardens, FL (US) 33016

( * ) Notice: Subject to any disclaimer, the term of this patent is extended or adjusted under 35 U.S.C. 154(b) by 0 days.

(21) Appl. No.: 09/287,827

(22) Filed: Apr. 7, 1999

(51) Int. Cl.[7] ..... A61G 15/00
(52) U.S. Cl. ..... 128/845; 600/38; 5/613
(58) Field of Search ..... 128/845, 846; 600/38; 5/85.1, 86.1, 613, 929

(56) References Cited

U.S. PATENT DOCUMENTS

| | | | | |
|---|---|---|---|---|
| 3,971,572 | | 7/1976 | Farley | 297/217 |
| 5,333,334 | * | 8/1994 | Kassai | 5/85.1 |
| 5,385,154 | | 1/1995 | Fuhrman et al. | 128/845 |
| 5,453,080 | * | 9/1995 | Mitchum | 128/845 |
| 5,456,655 | * | 10/1995 | Morris | 128/846 |
| 5,507,050 | * | 4/1996 | Welner | 5/600 |
| 5,538,011 | | 7/1996 | Craft et al. | 128/845 |

* cited by examiner

*Primary Examiner*—Michael A. Brown
(74) *Attorney, Agent, or Firm*—J. Sanchelima

(57) ABSTRACT

An apparatus for facilitating sexual relations with minimum movement by suspending a partner at controllable parallel and spaced apart relationship with respect to another partner resting on a flat cushioned surface. A cable assembly with several cables are cooperatively tied at one end to the suspended platform supporting one of the partners and the other end wound by spool members included in a motorized spool assembly. The activation of the motorized spool assembly brings the platform up and down. A reciprocating movement is also applied to the suspended platform, and all of these movements are controlled by a circuit that includes hard-wired or remote inputs.

7 Claims, 3 Drawing Sheets

FIG. 4
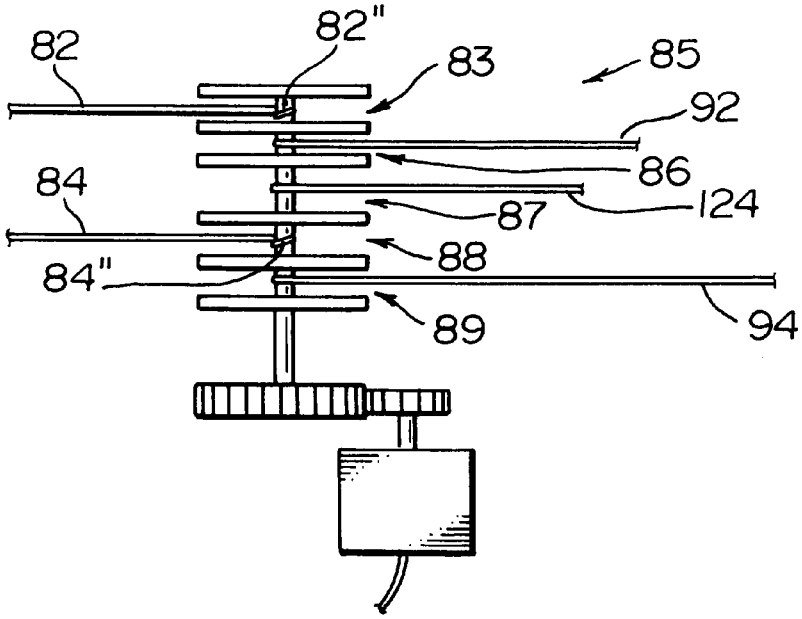
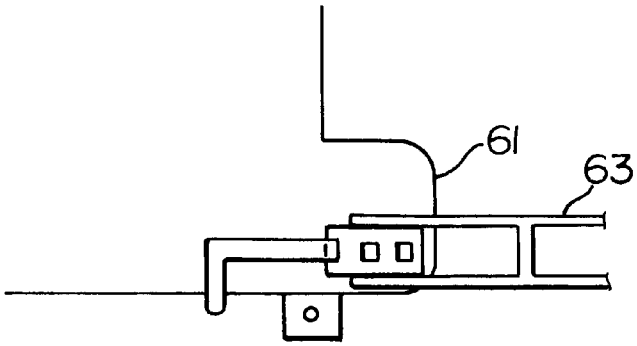
FIG. 5

BED WITH SUSPENDED PLATFORM

BACKGROUND OF THE INVENTION

1. Field of the Invention

The present invention relates to a bed with a suspended platform, and more particularly, to a bed that facilitates sexual intercourse by handicapped individuals.

2. Description of the Related Art

A number of devices has been designed in the past to help individuals engage in sexual intercourse. Some of these devices are disclosed in U.S. Pat. Nos. 5,385,154; 5,538,011 and 3,971,592. However none of them includes a suspended platform.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide an apparatus that facilitates engaging in sexual intercourse with a minimum of required movement of a user's body.

It is another object of this invention to provide an apparatus that is ergonomically designed with characteristics that are compatible with the functions typically associated with sexual intercourse.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 4 shows a front view of motorized spool assembly.

FIG. 5 is a bottom view of locking assembly for leg support member.

DETAILED DESCRIPTION OF THE PREFERRED EMBODIMENT

Figure 1:
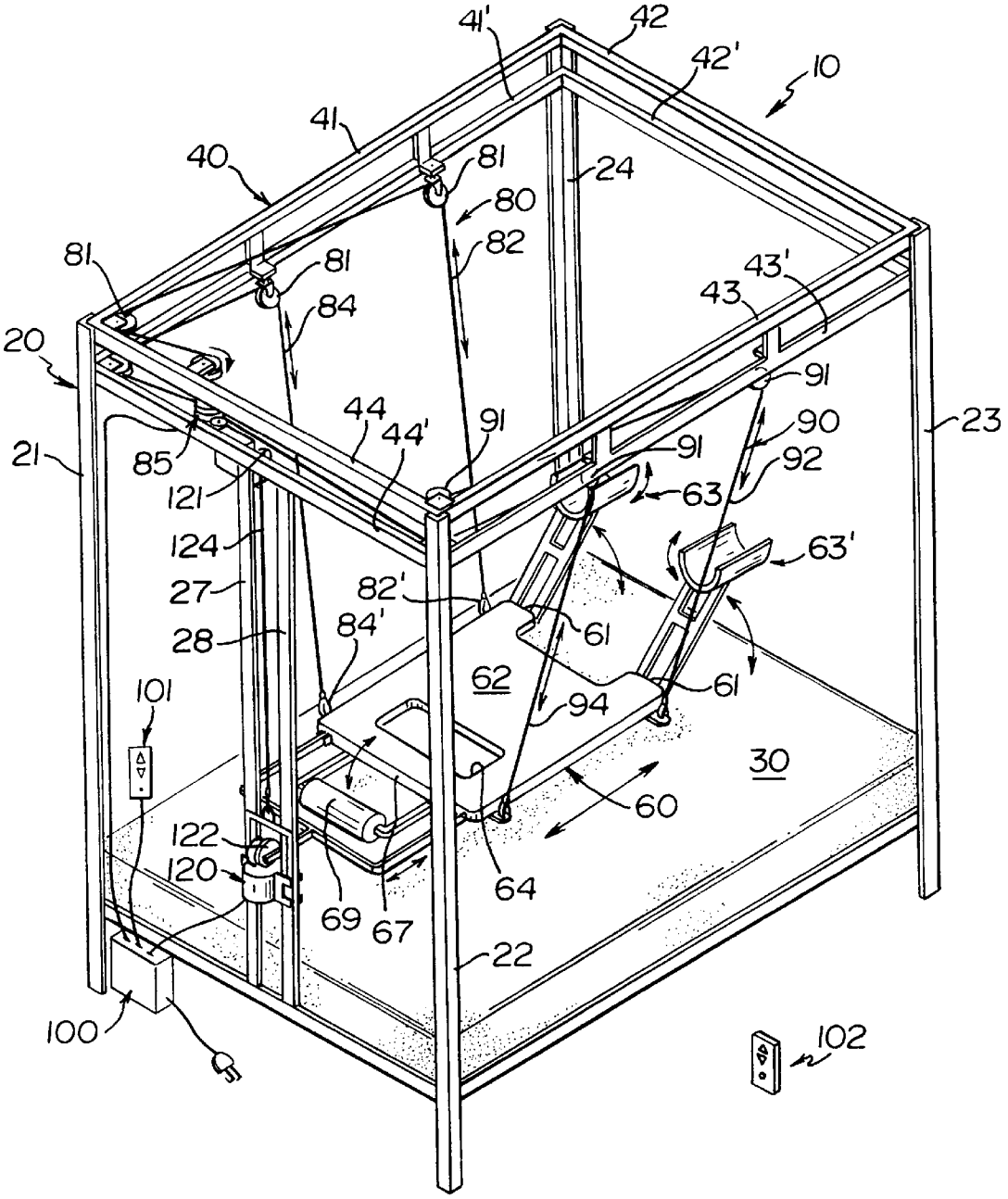
FIG. 1 represents an isometric view of the invention showing the different possible movements of the suspended platform.
Figure 2:
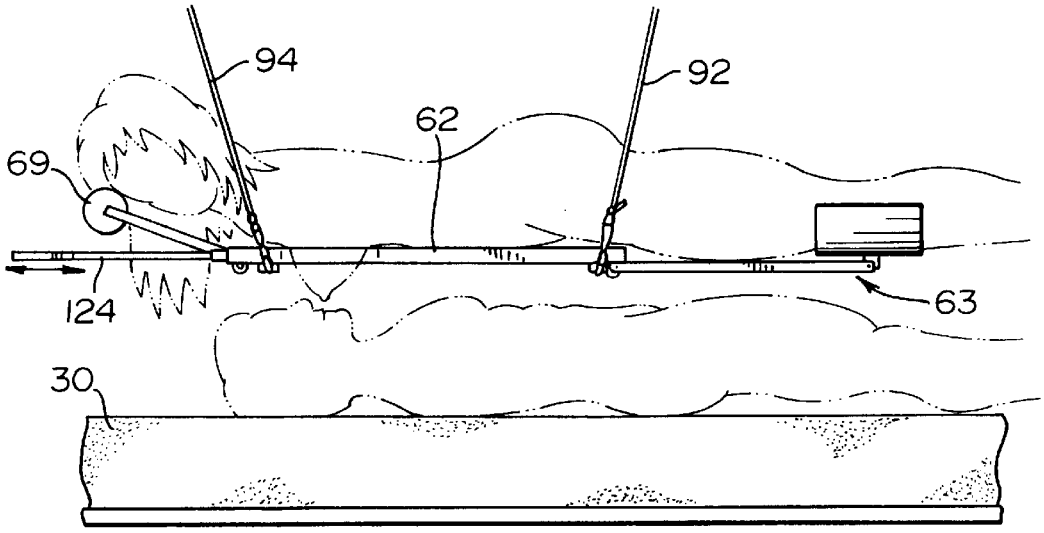
FIG. 2 shows a front view of preferred embodiment with users in phantom.
Figure 3A:
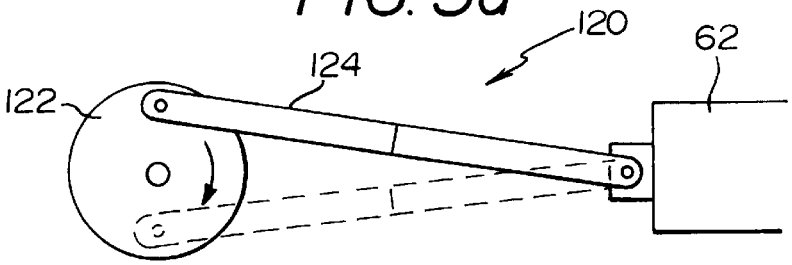
FIG. 3*a* is a front view of motorized wheel with shaft in up and down positions.
Figure 3B:
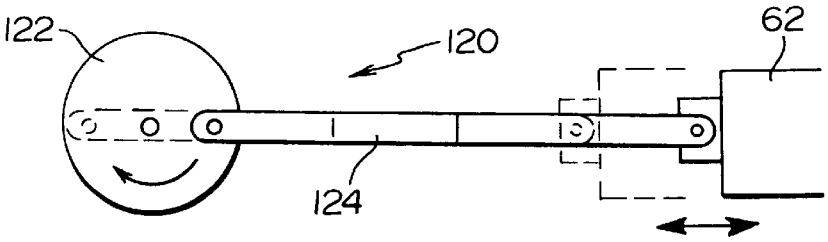
FIG. 3*b* is a front view of motorized wheel with shaft in extreme left and right position.

Referring now to the drawings, where the present invention is generally referred to with numeral 10, it can be observed that it basically includes housing assembly 20 with platform assembly 60 suspended their by cable assemblies 80 and 90 that are wound and un wound in motorized spool assembly 85. Motorized spool assembly 85 is controlled by electronic control unit 100 that includes A/C or battery supplies. The inputs to control unit 100 include hard wired and remote control units 101 and 102.

Housing assembly 20 includes upright elongated structural members 21; 22; 23 and 24 defining the corner of a space with a rectangular projection. Bottom 30 includes a cushioned flat surface where one of the users rests. Double frame assembly 40 has a substantially rectangular shape similar to the rectangular shape of bottom 30 with members 41; 41'; 42; 42'; 43; 43'; 44 and 44'.

Platform assembly 60 is suspended by cable assemblies 80 and 90. Cable assembly 80 includes cable members 82 and 84 with ends 82' and 84' tied to locations on one side of platform assembly 60, space apart from each other. The other ends, 82" and 84", are wound in motorized spool assembly 85, as shown in FIG. 1. A number of pulley members 81 and 91 are used to direct cables 82; 84; 92 and 94. Pulley member 121 directs cable 124. Platform assembly 60 includes a flat portion 62 with through opening 64 cooperatively located to permit the user (upper) to come in partial contact with the other user (lower). At one end 61 assembly 60, there is a central cutout to facilitate contact between the users in the genital area. Two leg support members 63 and 63' extend from end 61 and are ergonomically designed to confortably support the upper user's legs. The other end 67 of assembly 60 includes head roller 69 positioned at a spaced apart relationship with respect to end 67. Head roller 69 is made out of a soft material. Leg support members 63 and 63' may include an adjusting mechanism such as the one shown in FIG. 5 or other equivalent mechanism to enhance the confort of a user.

Motorized spool 85 includes five spool members 83; 86; 87; 88 and 89, as best seen in FIG. 4. Spool members 83 and 86 take in cables 82 and 84. Spool members 88 and 89 take in cables 92 and 94. Spool members 83; 86; 87; 88 and 89 have all the same diameters so that substantially the same length of cables 82; 84; 92 and 94 is taken in with a predetermined angular rotation.

Reciprocating movement assembly 120 is slidably mounted along upright guiding member 27 and 28. Assembly 120 includes a motorized wheel 122 that imparts a reciprocating movements to shaft 124. One end of shaft 124 is pivotally connected to motorized wheel 120 (at an off center location) while the other end is connected to end 67 of platform assembly 60.

Either the upper or lower user can control the movement of platform assembly 60 through hard-wired control 101 or remote control 102. The movement could be up or down and front or back.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An apparatus comprising:

A) a substantially flat cushioned surface;

B) a platform assembly suspended above said flat cushioned surface, said platform assembly including an ergonometric shape with an opening and a cutout to maximize contact between a first user resting on said flat cushioned surface and a second user resting on said platform assembly; and C) means for imparting movement to said platform assembly including control means for directing said movement wherein said means for imparting movement include a plurality of cables suspending said platform assembly and further including motorized spool means for taking in and unwinding said cables to raise and lower said platform.

2. The apparatus set forth in claim 1 wherein said means for imparting movement include motorized reciprocating means for delivering front to back movement to said suspended platform assembly.

3. The apparatus set forth in claim 2 wherein said platform assembly includes two ends, and one of said ends includes two leg resting members outwardly and longitudinally extending therefrom.

4. The apparatus set forth in claim 3 wherein said platform assembly includes head support means mounted to the other end of platform assembly.

5. The apparatus set forth in claim 4 wherein said leg resting members and said head support means include means for adjusting their positions.

6. The apparatus set forth in claim 5 wherein said spool means includes four spool members and four cables that are wound and unwound from said spool members simultaneously.

7. The apparatus set forth in claim 6 wherein said motorized reciprocating means includes a motorized wheel and a shaft with first and second ends, said first end pivotally mounted to said motorized wheel at an off center location and said second end pivotally mounted to said other end of said platform.

* * * * *